United States Patent [19]

Hikino et al.

[11] Patent Number: 4,649,654

[45] Date of Patent: Mar. 17, 1987

[54] APPARATUS FOR CONTROLLING ELECTRIC CLOTHES DRYER AND METHOD THEREFOR

[75] Inventors: Keiji Hikino, Hitachi; Shinichi Kaji, Katsuta; Shin Nakamura, Hitachi, all of Japan

[73] Assignee: Hitachi, Ltd., Tokyo, Japan

[21] Appl. No.: 845,334

[22] Filed: Mar. 28, 1986

[30] Foreign Application Priority Data

Mar. 29, 1985 [JP] Japan ..... 60-63900

[51] Int. Cl.[4] ..... F26B 3/04

[52] U.S. Cl. ..... 34/30; 34/48; 34/89

[58] Field of Search ..... 34/30, 48, 89

[56] References Cited

U.S. PATENT DOCUMENTS

| | | | |
|---|---|---|---|
| 3,234,449 | 2/1966 | Lang et al. | 34/89 |
| 4,019,259 | 4/1977 | Veraart | 34/48 |
| 4,132,008 | 1/1979 | Deschaaf | 34/48 |
| 4,531,307 | 7/1985 | Kuecker | 34/48 |

*Primary Examiner*—Albert J. Makay

*Assistant Examiner*—David W. Westphal

*Attorney, Agent, or Firm*—Antonelli, Terry & Wands

[57] ABSTRACT

Disclosed is an apparatus for controlling an electric clothes dryer having an electrical heater arranged to be supplied with electric power from a power source to generate heat so as to dry clothes by air heated by the heater, the apparatus comprising a switching device for opening/closing an electrical connection between the power source and the heater in response to a control signal, a voltage detecting circuit for detecting a voltage of the power source and for generating an overvoltage signal when the detected voltage exceeds a predetermined value, and a control signal generating circuit responsive to the overvoltage signal for generating the control signal for turning on/off the switching device. The control signal is formed so that the opening period of the switching device corresponds to the value of the overvoltage signal. Further, the opening period of the switching device is selected the value of power consumption per unit time of the heater always becomes a predetermined value in the case where the supply of power to the heater from the power source is stopped during the opening period of the switching device.

8 Claims, 11 Drawing Figures

APPARATUS FOR CONTROLLING ELECTRIC CLOTHES DRYER AND METHOD THEREFOR

BACKGROUND OF THE INVENTION

1. Field of the Invention

The present invention generally relates to an apparatus for controlling an electric clothes dryer, and particularly relates to an apparatus for performing controlling an electric clothes dryer so that a temperature at a respective portion of the electric clothes dryer is prevented from abnormally rising in the case where a voltage of a power source connected to the dryer exceeds a rated value thereof.

2. Description of the Related Art

Generally, in an electric clothes dryer, a current is caused to flow in an electrical heater to generate heat and air is heated by the thus generated heat to be applied onto clothes in a drum by using a fan so as to dry the clothes. In such a dryer as described above, a capacity of the heater for obtaining a predetermined clothes drying performance (ordinarily, represented by the weight of clothes which can be dried once) is determined, and if a resistance value of the heater is fixed once on the basis of the desired capacity of the heater, the electric power consumed by the heater is increased in proportion to a square of a voltage applied thereto as the voltage rises.

Generally, a voltage of a commercial power source line may fluctuate by ± several %, or ± over ten % in an extreme case, of the rated value thereof, and therefore also the power consumption in a heater, that is, a calorific value thereof varies in accordance with the voltage fluctuation. For example, when a heater is supplied with a voltage of 110% of a rated value thereof, a calorific value of the heater becomes a value of 1.21 times as large as that in the case of supplying the rated voltage. In such a case where the line voltage rises in the electric clothes dryer of the type as described above, therefore, the temperatures at portions in the surrounding of the heater and at portions to which hot air is applied become considerably high. Accordingly, if the capacity of the heater, and the respective dimensions and shapes of parts of the dryer are determined on the assumption that the rated voltage of the dryer does not rises, the temperature at the parts inside the dryer and at the clothes to be dried may abnormally rise in the case where the line voltage exceeds the rated value, resulting in a danger that the parts and the clothes may be damaged.

As measures to cope with such a rising in supply voltage as described above, there have been proposed a method in which the dryer is previously made to have air blowing capacity of the fan enough to large capable for increasing temperature due to voltage rise, a method in which gaps between a heater and parts disposed in the surrounding of the heater are made larger, a method in which a heater having a smaller surface power density is used, and so forth. In any method, the heater and the constituent parts are designed with an allowance in advance on the assumption that the supply voltage may rise higher than the rated value. In this case, there has been problems in manufacturing the dryer in that the shape of the dryer per se becomes larger than that in the case where the dryer is designed on the assumption that the supply voltage does not exceed the rated voltage, resulting in increase in cost of the dryer. Further, even if any one of the foregoing methods could cope with the rising in supply voltage so that the temperature rising in the parts of the dryer does not reach an abnormal value in the case where the supply voltage rises to a certain value, there is a possibility that when the dryer is used in a different commercial voltage zone, the dryer may exceed in quality relative to a requirement therefore, or, conversely, an abnormally high temperature may be generated.

SUMMARY OF THE INVENTION

An object of the present invention is therefore to solve the problems in the prior as described above.

Another object of the present invention is to provide an apparatus and a method for controlling an electric clothes dryer in which a temperature rising in case of abnormal rising in the supply voltage can be suppressed by a new method as well as a new arrangement.

Still another object of the present invention is to provide an apparatus for controlling an electric clothes dryer in which the supply of electric power to a heater is controlled so that a mean calorific value per unit time of the heater is made equal to that in the case where a rated voltage is supplied to the heater even when a power source voltage exceeding the rated value is supplied to the heater, thereby preventing abnormal temperature rising from occurring in the dryer.

In order to attain these objects, the apparatus for controlling an electric clothes dryer according to the present invention comprises: a switching device for opening/closing an electrical connection between a power source and a heater in response to a control signal; voltage detecting circuit for detecting a voltage of the power source and for generating an overvoltage signal when the detected voltage exceeds a predetermined value (a rated value), the overvoltage signal having a value representing an excess of the detected voltage over the predetermined value; and a control signal generating circuit responsive to the overvoltage signal for generating the control signal for turning on/-off the switching device. Further, an interval for turning on/off the switching device is selected in the control signal generating circuit so that a mean value of power consumption per unit time of the heater caused by turning on/off the switching device is equal to that in the case where a voltage of the power source is the rated value.

The above and other objects and features of the invention will appear more fully hereinafter from a consideration of the following description taken in connection with the accompanying drawings.

DETAILED DESCRIPTION OF THE PREFERRED EMBODIMENT

Figure 1:
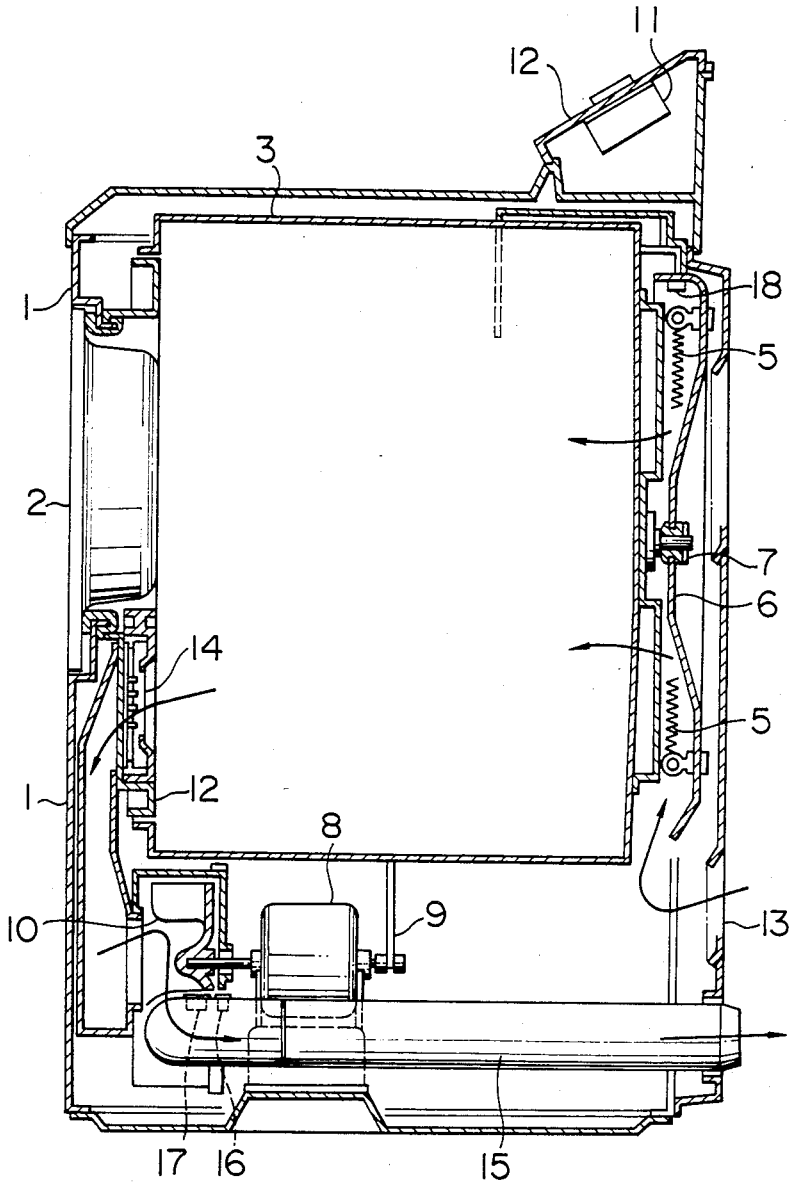
FIG. 1 is a side view in cross-section showing an electric clothes dryer to which the present invention is applied.

FIG. 1 is a side view in cross-section showing an embodiment of the electric clothes dryer according to the present invention. In FIG. 1, the reference numeral 1 designates a chassis of the dryer; 2, a door for taking in/out clothes; 3, a rotatable drum for accommodating the clothes; 5, heater acting as a heat source; 6, a heater casing; 7, a rotary shaft portion connected to the drum 3; 8, an electric motor for rotating the drum 3 through a belt 9; 10, a fan driven by the motor 8 for taking-in air from the outside of the dryer and for discharging exhaust air to the outside; 11, a control unit; and 12, a panel on which there are provided various switches for performing various operations of the dryer and a display device.

A basic operation of this electric clothes dryer is as follows. First, upon turning-on a power source, the motor 8 is energized to rotate the drum 3 and the fan 10, and at the same time, the heater 5 is energized to generate heat. In rotating of the fan 10, air is sucked from an air inlet 13, and the sucked air advances along an arrow in the drawing to reach the heater 5 to be heated thereby. The thus heated air is led into the drum 3 to dry clothes therein. Further, the air containing moisture is passed through a filter 14 so as to remove waste threads, and the air passed through the filter 14 is led into an exhaust duct 15 through the fan 10 so as to be discharged therefrom outwardly. The reference numerals 16 and 17 designate a humidity sensor portion and a thermostat, respectively, provided in the exhaust duct 15, and 18 designates a thermostat provided in the vicinity of the heater 5 for preventing the temperature of the heater 5 from rising abnormally.

Figure 2:
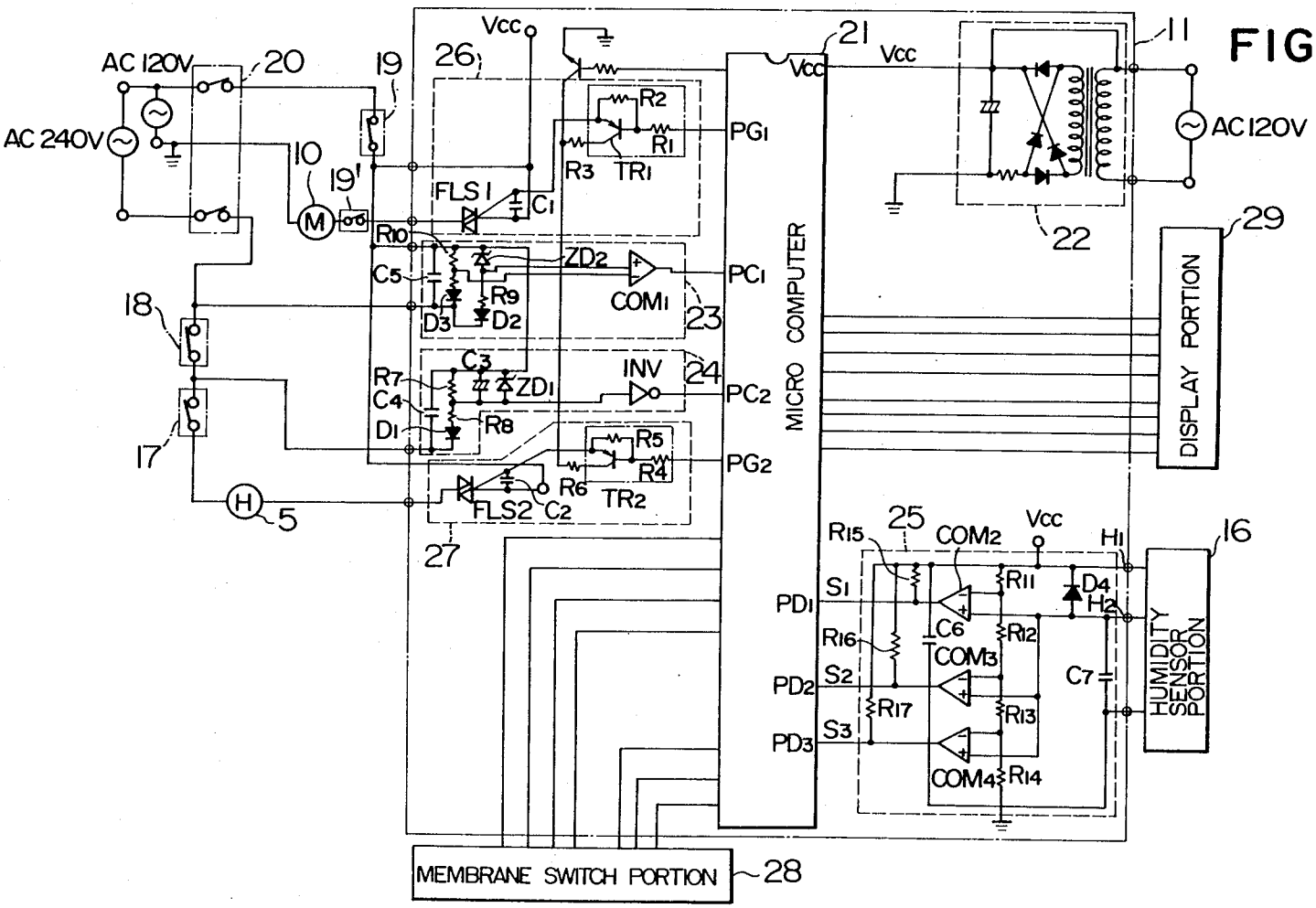
FIG. 2 is a circuit diagram of the apparatus for controlling an electric clothes dryer according to the present invention.

Referring to other drawings, description will be made as to an arrangement and an operation of the control unit 11. FIG. 2 is a circuit diagram of an embodiment of the control apparatus according to the present invention, including the control unit 11 and peripheral circuits thereof.

In FIG. 2, the reference numerals 19 and 19' designate door switches each provided between the chassis 1 and the door 2 and each arranged to be opened/closed in response to opening/closing of the door 2 respectively, and 20 designates a power switch provided on the panel 12 for turning on/off the power source. One terminal of an A.C. source of 240 V is connected to the control unit 11 through the power switch 20 and the door switch 19, while the other terminal of the same is connected to the control unit 11 through a series circuit constituted by the power switch 20, the thermostats 18 and 17, and the heater 5. One terminal of an A.C. source of 120 V is commonly connected to the one terminal of the A.C. source of 240 V, and the other terminal of the A.C. source of 120 V is connected to the control unit 11 through a series circuit constituted by the motor 10 and the door switch 19'. In the control unit 11, the reference numeral 21 designates a known microcomputer which may be, for example, an HMCS44C type microcomputer made by HITACHI, Ltd.. It is a matter of course that any other microcomputer may be used as long as it has the same performance as that of the above-mentioned one. The control unit 11 is provided with a rectifier unit 22 which receives an A.C. voltage of 120 V to generate a D.C. voltage Vcc to be supplied to the control unit 11. This A.C. voltage of 120 V may be commonly supplied from an A.C. source of 120 V applied to the motor 10. The rectifier unit 22 is a well-known circuit constituted by a transformer, a full wave rectifier diode bridge, a filter capacitor, and therefore the explanation is omitted. A constant-voltage circuit may be connected to an output of this rectifier unit 22. There are provided a large number of input and output ports in the microcomputer 21. Of the ports, an input port $PC_1$ is provided for detecting a voltage of the A.C. source of 240 V for energizing the heater 5 and connected to an overvoltage detecting circuit 23 which is arranged such that when a voltage of the A.C. source of 240 V is applied to the heater 5, the voltage is also applied to an input of the overvoltage detecting circuit 23. An input port $PC_2$ is connected to a heater temperature detecting circuit 24 for detecting a status (an opened or closed status) of the thermostat 18 provided in the vicinity of the heater 5. Input ports $PD_1$, $PD_2$, and $PD_3$ are connected to terminals $S_1$, $S_2$, and $S_3$ of a humidity detecting circuit 25 respectively. The humidity detecting circuit 25 detects a voltage across the humidity sensor portion 16 provided in the exhaust duct 15 and produces humidity of exhaust air in values of three stages at the output terminal $S_1$, $S_2$, or $S_3$. The operation of the humidity detecting circuit 25 will be described in detail later. An output port $PG_1$ is connected to a motor drive control circuit 26 which is serially connected between the motor 10 and the A.C. source of 120 V and arranged to open/close a motor circuit in response to an output signal from the output port $PG_1$ of the microcomputer 21. An output port $PG_2$ is connected to a heater drive control circuit 27 which is serially connected between the heater 5 and the A.C. source of 240 V and arranged to open/close a heater circuit in response to an output signal from the output port $PG_2$ of the microcomputer 21. In addition to the circuits described above, a membrane switch portion 28 and a display section 29 are connected to the microcomputer 21 through a plurality of lines respectively. In the membrane switch portion 28, there are provided switches for selecting various drying processes (drying modes) and a start switch (not shown) for instructing start of a drying operation to the microcomputer 21. The display section 29 is provided for visually displaying a progressing status of the drying process or for warningly displaying an abnormal temperature. These displays are set in different fashions in various dryers depending on the type of thereof.

The operation of this control apparatus will be described more in detail.

In the arrangement as described above, assume now that the power switch 20 is turned on, clothes being washed (hereinafter referred to as washing) are put into the drum 3, and the door 2 is closed. Then, the door switches 19 and 19' are closed. If a start switch (not shown) of switches in the membrane switch portion 28 is turned on after a desired drying process has been designated by a selected one of the switches of the membrane switch portion 28, a start signal for starting the designated drying process is applied from the membrane switch portion 28 to the microcomputer 21 which in turn applies a low level output to the output ports $PG_1$ and $PG_2$ in response to the received start signal. When the low level output is applied to a base of a transistor $TR_1$ through a resistor $R_1$ in the motor drive control circuit 26, the transistor $TR_1$ is turned on, so that a current is allowed to flow into a gate circuit of a triode AC switch $FLS_1$ from a D.C. source voltage Vcc so as to turn on the triode AC switch $FLS_1$. A capacitor $C_1$ is provided for preventing miss ignition of triode $FLS_1$. The respective resistance values of the resistors $R_1$ and $R_2$ are set in accordance with the operation potential for the turning on/off of the transistor $TR_1$, while the resistance value of a resistor $R_3$ is determined in accordance with a trigger current flowing in the triode AC switch $FLS_1$. When the triode AC switch $FLS_1$ is turned on, the motor circuit is established to energize the motor 10 so as to drive the drum 3 and the fan 10 to rotate. Simultaneously with the application of the low level output to the transistor $TR_1$, the low level output received by the output port $PG_2$ is applied to a base of a transistor $TR_2$ of the heater driver control circuit 27 to turn on the transistor $TR_2$ to thereby a current is allowed to flow into a gate circuit of a triode AC switch $FLS_2$ from the D.C. source voltage Vcc to turn on the triode AC switch $FLS_2$. Resistors $R_4$, $R_5$ and $R_6$, and a capacitor $C_2$ act in the same manner as those of the motor drive control circuit 26. When the triode AC switch $FLS_2$ is turned on, the heater circuit is established to allow a current to flow into the heater 5 from the A.C. source of 240 V. The thermostats 17 and 18 normally closed and connected in series to the heater circuit are arranged to be opened to thereby break the heater circuit in the case where an exhaust temperature and a heater temperature exceed predetermined values respectively. When the current flows into the heater 5, hot air heated by the heater 5 is led into the drum 3 by the fan 10 so as to be applied onto the washing in the drum 3 to start the same.

Figure 3:
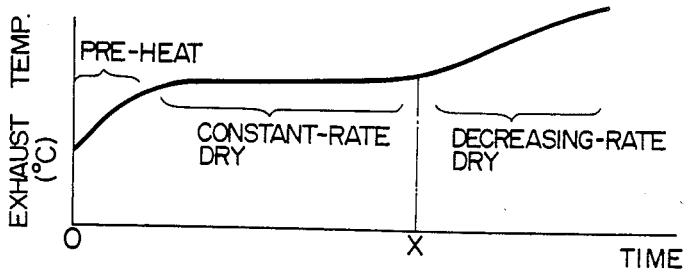
FIG. 3 is a graph showing the relationship between time and an exhaust temperature in a drying process.

Thus, in the beginning of the drying process, a calorific value is used for preheating a machine body and the washing. FIG. 3 shows the relationship between an exhaust temperature and drying time. At first, the exhaust temperature at an outlet of the drum 3 gradually rises in a stage which is referred to as a preheating range. Next, after the preheating range has been completed, the calorific value is mostly consumed as latent heat for evaporating moisture in the washing, and the exhaust temperature at the outlet of the drum 3 becomes substantially constant as shown in FIG. 3 in a succeeding stage which is referred to as a constant-rate drying range. Here, the term "constant rate" means that the rate of change in dryness factor is constant.

When the drying process is further progressed, the moisture in the washing becomes less, and the calorific value is consumed as sensible heat for heating air, so that the exhaust temperature at the outlet of the drum 3 begins rising as shown in FIG. 3 in the next state which is referred to as a decreasing rate drying range. Here, the term "decreasing rate" means that the rate of change in dryness factor gradually decreases.

Figure 4:
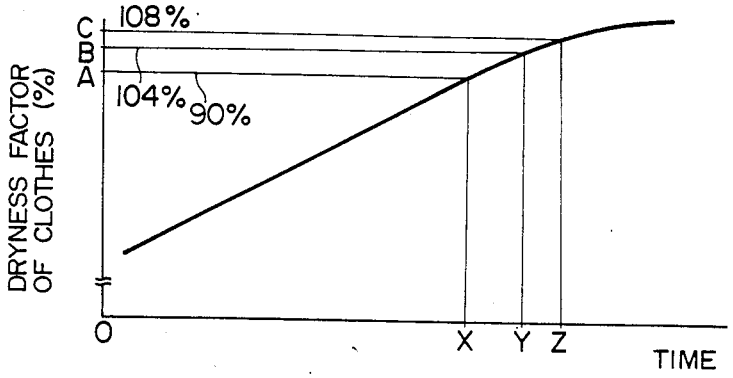
FIG. 4 is a graph showing the relationship between time and a rate of dry of clothes in a drying process.
Figure 5:
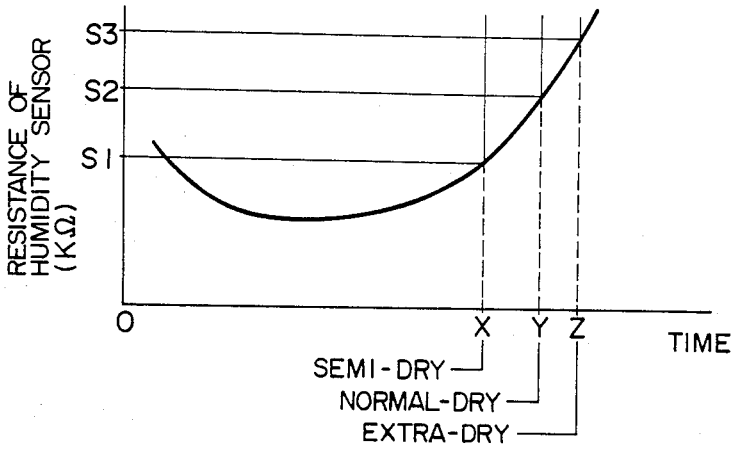
FIG. 5 is a graph showing the relationship between time and a resistance value of the humidity sensor in a drying process.

FIGS. 4 and 5 show transitions of the dryness factor (%) of clothes and a resistance value of a humidity sensor of the humidity sensor portion 16 relative to a lapse of the drying time respectively.

Generally, the decreasing rate drying range as described above begins from a point X shown in FIGS. 4 and 5, and the dryness factor in the point X is equal to about 90% (A). At this time, the humidity detecting circuit 25 detects a resistance value of the humidity sensor and produced an output signal corresponding to the detected resistance value to the output terminal $S_1$. The exhaust temperature at the outlet of the drum 3 is rising in the decreasing rate drying range, so that the dryness factor becomes about 104% (B) at a point Y. At this time, the humidity detecting circuit 25 detects the resistance value of the humidity sensor and produces an output signal corresponding to the detected resistance value to the output terminal $S_2$. When the drying process is further progressed to reach a point Z, the dryness factor at this time becomes about 108% (C). The humidity detecting circuit 25 detects the resistance value of the humidity sensor at this time and produces an output signal corresponding to the detected resistance value to the output terminal $S_3$. The drying process selected by the membrane switch portion has three modes which are different from each other depending on the fact at which point of the dryness factor the drying process is ended.

Of those mode, one being SEMI DRY MODE for ironing, in which the drying process is terminated at the point having the dryness factor of 90%; another being NORMAL DRY MODE for drying the washing at the standard drying state, in which the drying process is terminated at the point having the dryness factor of 104%; and the remainder being EXTRA DRY MODE for further drying the washing, in which the drying process is completed at the point having the dryness factor of 108%. For example, in the SEMI DRY MODE for ironing, it will do to produce a high level signal to the output port $PG_2$ on the basis of a program stored in the microcomputer 21 when the humidity detecting circuit 25 produces an output to the output terminal $S_1$. When the high level signal is produced to the output port $PG_2$, the transistor $TR_2$ is cut-off, so that the triode AC switch $FLS_2$ is turned off to cause the heater 5 to stop heating. Thereafter, when a high level signal is produced to the output port $PG_1$ with a predetermined time delay, the transistor $TR_1$ is cut-off, so that the triode AC switch $FLS_1$ is turned off to stop the energization of the motor 10 to thereby terminate the drying process. The reason why the stopping of the motor 10 is delayed is to perform cooling-down in the drum 3. To cause the two remainder modes to operate, it will do to make programming so as to effect the same operation as described above when the humidity detecting circuit 25 produces outputs to the output terminal $S_2$ and $S_3$ respectively. Selection of the mode is performed by the membrane switch portion 28.

Here, an explanation will be made as to the terminology "dryness factor" which is used in this specification. The definition of "dryness factor" is as follows in accordance with Japanese Industrial Standard (JIS):

$$\text{Dryness factor} = \frac{\text{a reference mass of the washing}}{\text{a mass of the washing after dried}} \times 100\%$$

Further, according to JIS, the reference mass of the washing is defined as follows.

When the reference mass of the washing is measured, it is a standard that the washing is left as it is all day long under the conditions of a temperature of 20°±2° C. and of relative humidity of 65±5%, and a measurement is performed after a mass of the washing has become constant.

When it is impossible to perform the processing under the foregoing conditions, the washing is put into an electric clothes dryer to dry the washing, and immediately after the washing has been dried, a mass thereof is measured. Then, the washing is dried for ten minutes and the measurement is effected, the measurement being repeated till a change in mass obtained by the measurement becomes 1% or less of the mass measured in a first step. A sum of the thus obtained bone-dry mass and 8% thereof is defined as the reference mass of the washing.

The dryness factor of 100% in accordance with JIS represents a state where the clothes are actually substantially completely dried. A comparison of the dryness factor between JIS and U.S. Standard is as follows.

| JIS (%) | U.S.A. (%) |
|---|---|
| 108 | 100 |
| 104 | 96.3 |
| 90 | 83.3 |

During the drying process as described above, when the filter 14 becomes in its loading state to decrease the quantity of passed air, the temperature in the vicinity of the heater 5 rises, so that the thermostat 18 is opened to break the heater circuit. If the drying operation is continued even after the washing has been completely dried, the temperatures at the inside of and the outlet of the drum 3 rise, so that the thermostat 17 is opened to break the heater circuit. In the case where the filter 14 is in its loading state, it is necessary to maintain the heater circuit in its broken state even if the thermostat 18 is returned into its closed state, because it is dangerous to perform the drying operation again. Upon detecting an opened state of the thermostat 18, the heater temperature detecting circuit 24 applies a signal to the input port $PC_2$ of the microcomputer 21 which is in turn responsive to the received signal to produce a high level signal to the output port $PG_2$ to break the heater circuit.

Here, description will be made as to the operation of the heater temperature detecting circuit 24. First, when the thermostat 18 is closed (in a normal state), a Zener current flows into a Zener diode $ZD_1$, so that the potential at the anode of the Zener diode $ZD_1$ is maintained at a Zener potential (selected to be equal to the D.C. voltage Vcc). However, since the D.C. voltage Vcc is applied to the cathode of the Zener diode $ZD_1$, the potential at the cathode is equal to that at the anode. Consequently, the signal level at the input of an invertor INV is low and the level at the inverted output of the invertor INV becomes high. Thus, even if a high level signal is applied to the input port $PC_2$, a low level signal is continuously produced at the output port $PG_2$. Next, when the thermostat 18 is opened (in a state of abnormal heater-temperature), the potential at the anode of the Zener diode $ZD_1$ becomes zero, so that a high level signal is applied to the invertor INV. The signal level at the inverted output of the invertor INV is therefore made low, so that the output port $PG_2$ produces a high level signal to break the heater circuit. A diode $D_1$ of the heater temperature detecting circuit 24 is provided for obtaining a negative half cycle of the A.C. voltage, and resistors $R_7$ and $R_8$ are provided for determining the potential at the anode of the Zener diode $ZD_1$. Capacitors $C_3$ and $C_4$ are provided for filtering of ripple and noises of the voltage source, respectively.

Figure 6:
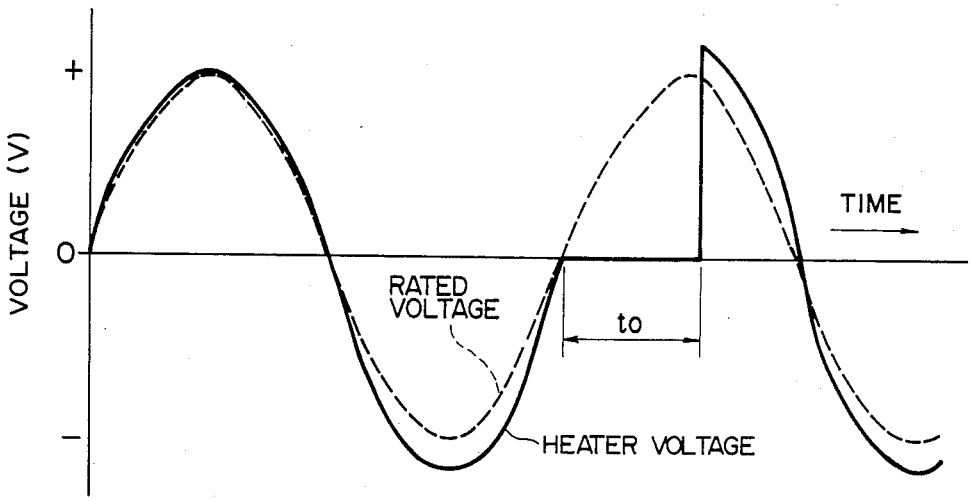
FIG. 6 is a diagram showing a waveform of a voltage supplied to the heater.

Next, description will be made as to the operation of the control apparatus in the case where an A.C. supply voltage exceeds the rated value. When a voltage of the A.C. source of 240 V exceeds the rated value, the overvoltage detecting circuit 23 detects the exceeding state and produces a signal having a pulse width corresponding to an excess of the detected value over the rated value to the input port $PC_1$ of the microcomputer 21. The microcomputer 21 counts the pulse width to calculate a period of time during which the heater circuit is made in its opened state, and produces a signal having a level which is made high only during the period of time during which the heater circuit is made in its opened state, from the output port $PG_2$. The heater circuit is broken during the period of time, and after the period of time has elapsed the signal level at the output port $PG_2$ becomes low to close the heater circuit. In the case where the A.C. supply voltage is exceeding the rated value upon the closure of the heater circuit, the overvoltage detecting circuit 23 produces a signal having a pulse width corresponding to an excess of the detected value over the rated value into the input port $PC_1$. The next operation is the same as that described above. When the supply voltage does not exceed the rated value, the overvoltage detecting circuit 23 produces no output signal, and therefore a low level signal is continuously produced at the output port $PG_2$ of the microcomputer 21. Thus, the heater circuit is opened during a period corresponding to an excess of the detected supply voltage over the rated value and then closed so that the opening/closing of the heater circuit is repeated. FIG. 6 shows a state of waveform of the supply voltage applied to the heater 5 when the supply voltage exceeds the rated value. A broken line shows a waveform of the rated voltage and a solid line shows a waveform of the supply voltage applied to the heater 5. Detection is made whether the supply voltage applied to the heater 5 is an overvoltage or not in a negative half cycle of the A.C. voltage from the power source. When an overvoltage is detected, a high level signal is produced from the output port $PG_2$ of the microcomputer 21 during a period $t_0$ so as to break the heater circuit during this period, the waveform of the supply voltage applied to the heater 5 in this duration being as shown in FIG. 6. Thereafter, the supply voltage is detected again in a negative half cycle thereof, and when the voltage is within the rated value, the heater circuit is maintained in its closed state. When the voltage exceeds the rated value, on the contrary, the heater circuit is opened during a certain period.

Figure 7:
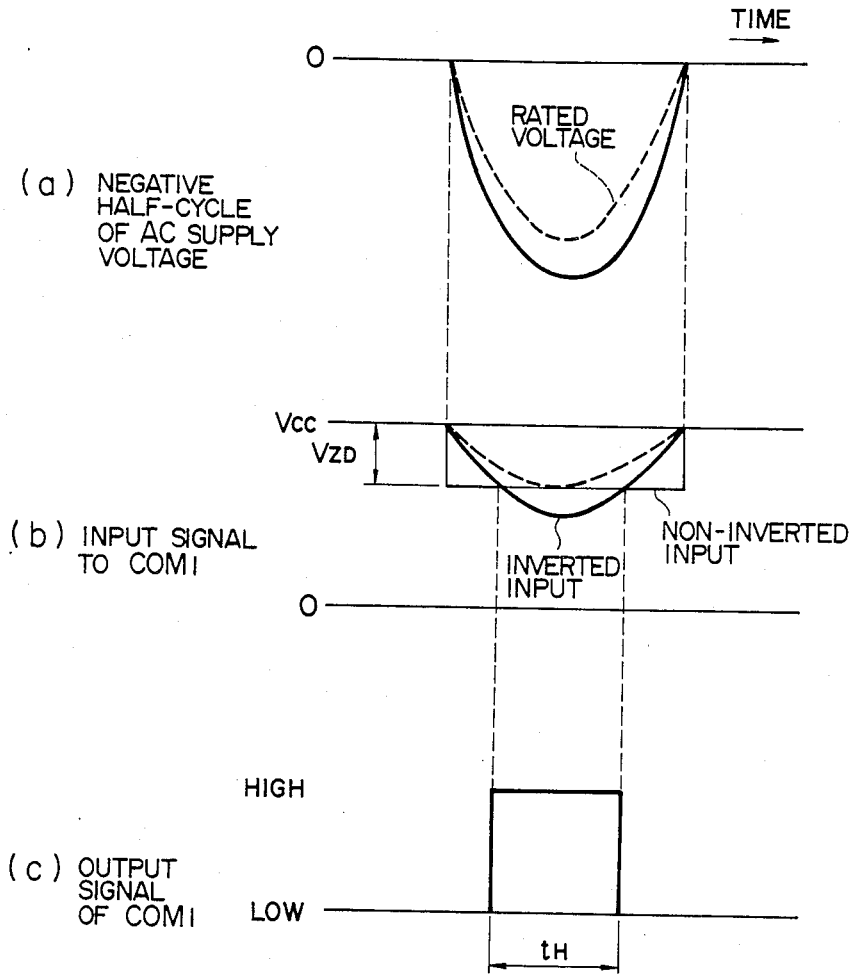
FIG. 7 is a diagram of waveform for explaining an operation of the overvoltage detecting circuit.

Here, referring to the circuit diagram of FIG. 2 and the waveform diagram of FIG. 7, the operation of the overvoltage detecting circuit 23 will be described more in detail. When the voltage of the A.C. source of 240 V is being applied to the heater 5, a Zener current flows into a Zener diode $ZD_2$ during a negative half cycle of the supply voltage, so that the voltage across the opposite electrodes of the Zener diode $ZD_2$ is maintained at a predetermined Zener voltage $V_{ZD}$, and a value of the Zener current is determined by a resistor $R_9$. A diode $D_2$ is provided for detecting the supply voltage only during a negative half cycle thereof. The reference symbol $COM_1$ designates a comparator having two, inverted and non-inverted inputs, and the potential at the non-inverted input is fixed to the Zener voltage $V_{ZD}$. The supply voltage is allowed to be applied to the inverted input of the comparator $COM_1$ during a negative half cycle of the supply voltage by a diode $D_3$, and the voltage value at that time appears across the opposite ends of a resistor $R_{10}$. Therefore, the same supply voltage as applied to the heater circuit is thus applied to the inverted input of the comparator $COM_1$. The comparator $COM_1$ produces a signal corresponding to a difference between the Zener voltage $V_{ZD}$ and the supply voltage. That is, if the Zener voltage $V_Z$ is selected to be the rated value and when the supply voltage exceeds the rated value, the pulse width $t_H$ of the output of the comparator $COM_1$ is prolonged by a value corresponding to an excess of the supply voltage over the rated value.

Figure 8:
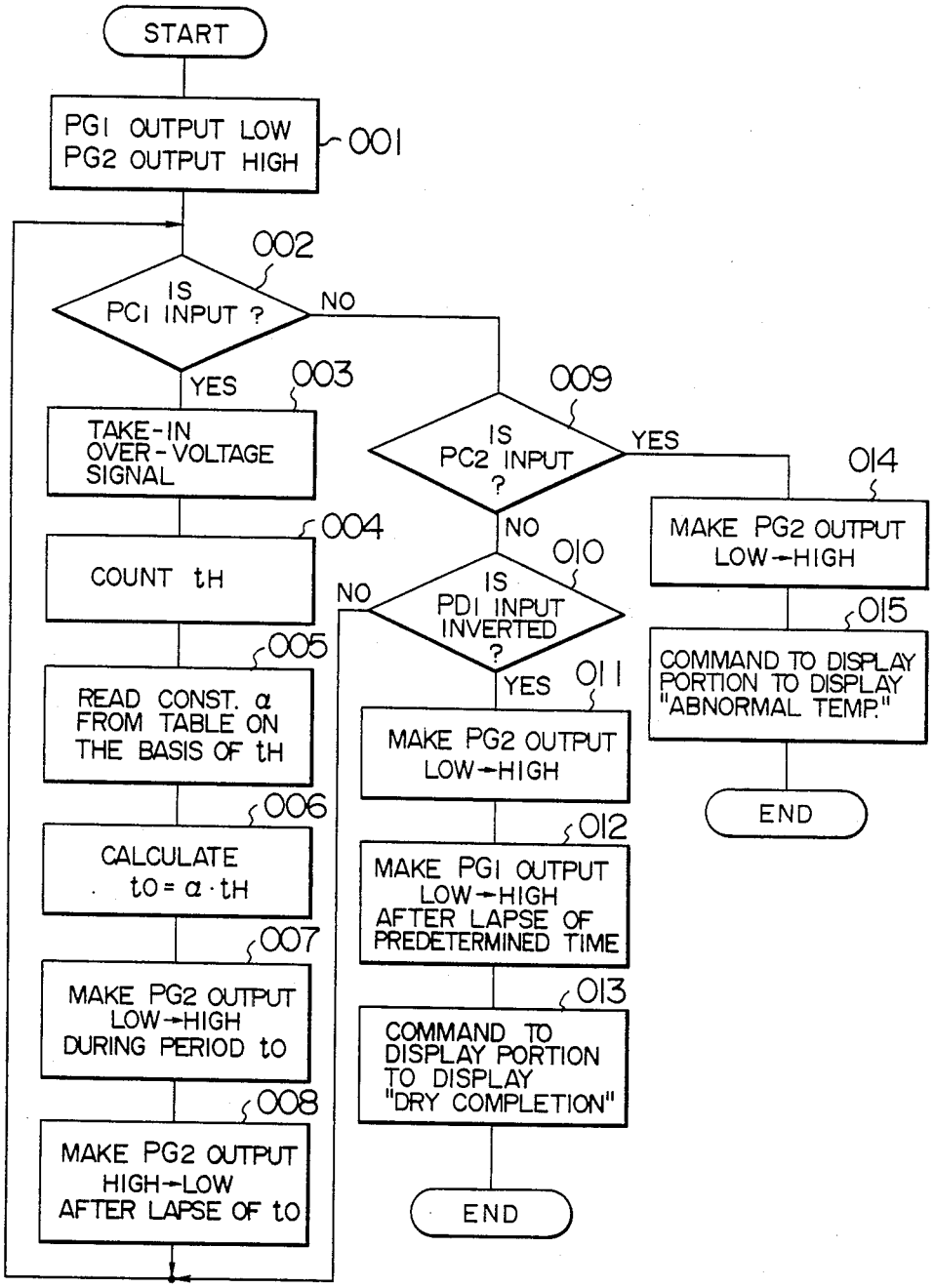
FIGS. 8 and 9 are flowcharts showing operation procedures of the microcomputer of the control apparatus according to the present invention.

Next, description will be made as to the procedure of the microcomputer 21 for determining the period $t_0$ during which the heater circuit is opened. FIG. 8 is a flowchart for execution a program in the case of SEMI DRY MODE in which the drying process is completed at the point having the dryness factor of 90%. Further, the procedures in the case of other modes are executed basically in the same manner as this flowchart.

First, when the drying operation is instructed to the microcomputer 21 by turning on the start switch of the membrane switch 28 in a step 001, a low level signal is produced to the output ports $PG_1$ and $PG_2$. Next, in a step 002, judgement is made as to whether there exists an input signal (an overvoltage signal) at the input port $PC_1$ or not. If yes, this means that the overvoltage detecting circuit 23 detects the fact that the supply voltage exceeds the rated value. In a step 003, the overvoltage signal is taken in. In a step 004, a pulse width $t_H$ of the overvoltage signal is counted. In a step 005, a constant $\alpha$ corresponding to the counted value of the pulse width $t_H$ is read out of a table in a memory. In a step 006, the value of the period $t_0$ during which the heater circuit is opened is calculated by performing an operation through an expression: $t_0=\alpha \cdot t_H$. The value of the constant $\alpha$ is determined in advance by an experiment. That is, a relationship between the period $t_0$ and the pulse width $t_H$ is set in advance such that the power consumption by the heater is always maintained to a mean value of power consumption per unit time under the condition that the rated voltage is applied to the heater 5. In advance, a plurality of values of the constant are obtained so as to satisfy an expression $\alpha=t_0/t_H$, and thus obtained values are stored as a table $t_H$ versus into the memory (not shown) in the microcomputer 21. Next, in a step 007, the level of the output at the output port $PG_2$ is varied from low to high during the period $t_0$. In a step 008, the level of the output at the output port $PG_2$ is varied from high to low after the period $t_0$ has elapsed. The operation is returned to the step 002 again. If the judgement in the step 002 proves that there exists no input at the input port $PC_1$, on the contrary, this means that the supply voltage does not exceed the rated value. In this case, in a step 009, further judgement is made as to whether there exists an input at the input port $PC_2$ or not. If no, further judgement is made in a step 010 as to whether an input at the input port $PD_1$ is inverted or not. The inversion of the input at the input port $PD_1$ means that a signal at the output terminal $S_1$ of the humidity detecting circuit 25 is inverted. Description will be made later as to the humidity detecting circuit 25. This inversion is effected when the dryness factor has reached the target value of 90%. When the input at the input port $PD_1$ is not yet inverted, the dryness factor has not reached the target value of 90%, and therefore the operation is returned to the step 002. In the case where the input exists at the input port $PD_1$ in the step 001, on the contrary, a level of an output signal at the output port $PG_2$ is made from low to high after a predetermined time has elapsed. In a step 013, the display portion 29 is informed of the completion of SEMI DRY MODE. If the judgement proves in the step 009 that there exists an input at the input port $PC_2$, on the contrary, this means that the thermostat 8 is opened because the heater temperature is abnormal. In this case, the level of the output signal at the output port $PG_2$ is made from low to high in a step 014. In a step 015, the display portion 29 is caused to display the fact that the heater temperature is abnormal.

Here, the operations of the humidity detecting circuit 25 and the humidity sensor portion 16 will be described more in detail. As the humidity sensor portion 16, a known semiconductor sensor (not shown) for measuring humidity of air is available. Generally, a humidity sensor has such a characteristic that a resistance value thereof becomes smaller as the relative humidity of air becomes higher, and vice versa. Therefore, when a resistance value of a humidity sensor is detected in the form of a voltage, the humidity of air is measured. The humidity sensor portion 16 produces an output signal of which level corresponds to a resistance value of the humidity sensor at output terminals $H_1$ and $H_2$ by known means.

In the embodiment of FIG. 2, the humidity detecting circuit 25 is provided with three comparators $COM_2$, $COM_3$, and $COM_4$. Respective non-inverted inputs of the comparators are commonly connected to the output terminal $H_2$ of the humidity sensor portion 16 while respective inverted inputs of the same are connected to junctions of serially connected resistors $R_{11}$, $R_{12}$, $R_{13}$, and $R_{14}$. The voltage Vcc is applied across the series connection of the resistors, and therefore the reference potentials applied to the respective inverted inputs of the comparators are different from each other. The respective resistance values of the resistor $R_{11}$ to $R_{14}$ are selected so that the respective voltages at the non-inverted inputs of the comparators $COM_2$ to $COM_4$ become smaller than the respective reference voltages at the inverted inputs respectively, when the humidity sensor portion 16 produces a predetermined output voltage (the value representing the relative humidity of 90%, 104%, or 108%) across the terminals $H_1$ and $H_2$. When the drying process is progressed and the dryness factor becomes high, the humidity of the exhaust air falls. Therefore, the resistance value of the humidity sensor becomes small, so that the output voltage of the humidity sensor portion 16 becomes low. At first, at the point having the dryness factor of 90%, the voltage at the terminal $H_2$ of the humidity sensor portion 16, that is, the voltage at the non-inverted input of the comparator $COM_2$, becomes smaller than the reference voltage at the inverted input of the comparator $COM_2$, so that the output signal $S_1$ of the comparator $COM_2$ is inverted. The microcomputer 21 detects the fact that the dryness factor has reached the target value of 90% by the inversion of the input signal to the input port $PD_1$. When the drying process is further progressed and the dryness factor reaches another value of 104%, the output signal $S_2$ of the comparator $COM_3$ is inverted. When the dryness factor reaches a further value of 108%, the output signal $S_3$ of the comparator $COM_4$ is inverted.

Although having been performed for the whole period of the drying process, the foregoing control operation upon rising of a supply voltage may be, alternatively, performed only for a specific partial period in the drying process without performing the on-off control of the heater circuit for the remainder period in the drying process even when the supply voltage exceeds the rated value. For example, the exhaust temperature is not so high in the preheating range and the constant rate drying range as shown in FIG. 3, and therefore even if the supply voltage rises, it is possible to utilize an increased calorific value due to the rising in the supply voltage for further progressing the drying process in those ranges. Therefore, it is possible to attain the objects of the present invention even if the control apparatus is caused to operate only during the decreasing rate drying range in which the exhaust temperature becomes high. Referring to a flowchart of FIG. 9, the procedure in this case will be described hereunder.

Figure 9:
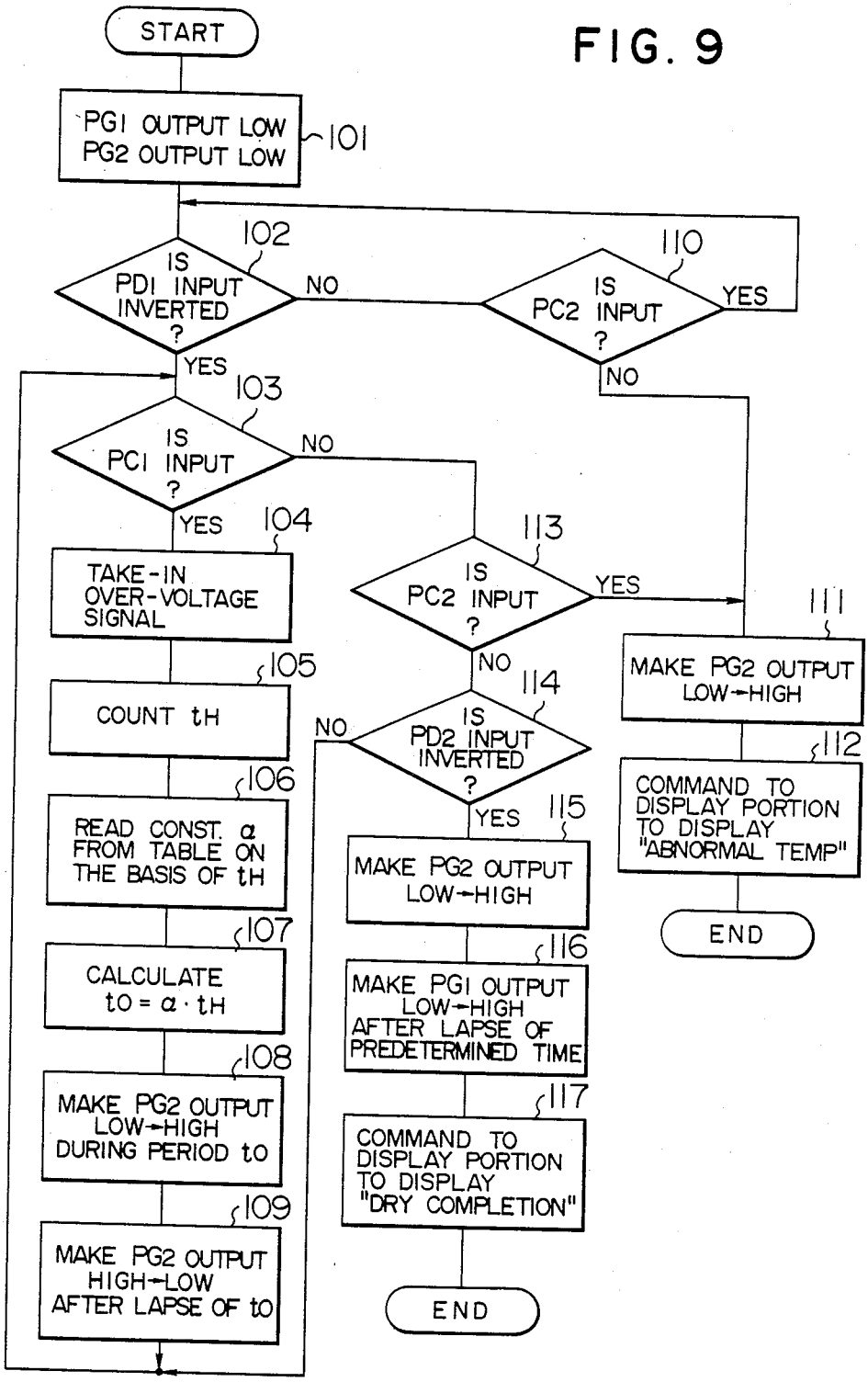

In order to perform the control only in the decreasing rate drying range, it is necessary to detect the fact that the operation enters the decreasing rate drying range, and this detection is effected by the detection of the point A in FIG. 4 by the humidity sensor portion 16. The flowchart of FIG. 9 is for an example of operation in the case of NORMAL DRY MODE. The explanation as to the steps common to those in the flowchart of FIG. 8 is suitably omitted. First, when the start switch is turned on, an instruction of performing the drying operation is given to the microcomputer 21. In a step 101, a low level signal is produced to the output ports $PG_1$ and $PG_2$. In a step 102, judgement is made as to whether the input signal to the input port $PD_1$ is inverted or not. If yes, this means that the operation of the dryer has entered the decreasing rate drying range. In this case, judgement is made in the next step 103 as to whether there exists an input at the input port $PC_1$. If there exists an overvoltage signal at the input port $PC_1$, steps 104 to 109 are successively continuously executed. The steps 104 to 109 are the same as those steps 003 to 008 of FIG. 8 respectively. If the judgement in the step 102 proves that the input at the input port $PD_1$ is not inverted, on the contrary, this means that the operation in drying process does not yet enter the decreasing rate drying range, and therefore both the respective outputs at the output ports $PG_1$ and $PG_2$ are maintained at low levels. In a step 110, judgement is made as to whether there exists an input at the input port $PC_2$, and if no, the operation is returned to the step 102 again. If the judgement in the step 110 proves that there exists an input at the input port $PC_2$, on the contrary this means the heater temperature has become abnormal, and steps 111 and 112 are successively continuously executed. The steps 111 and 112 are the same as those steps 014 and 015 of FIG. 8 respectively. If the judgement in the step 103 proves that there exists no input at the input port $PG_1$, steps 113 to 117 are successively continuously executed. Steps 113 to 117 are basically the same as the steps 009 to 013 of FIG. 8 respectively. The steps 010 and 114, however, are different from each other in that in the step 010 of FIG. 8, the judgement is made as to whether the input at the input port $PD_1$ is inverted or not, while in the step 114 of FIG. 9 corresponding to the step 010, the judgement is made as to whether the input at the input port $PD_2$ is inverted or not. Thus, it is possible to perform the control of the heater circuit in the rising of a supply voltage only in the decreasing rate drying range by the foregoing procedure.

Figure 10:
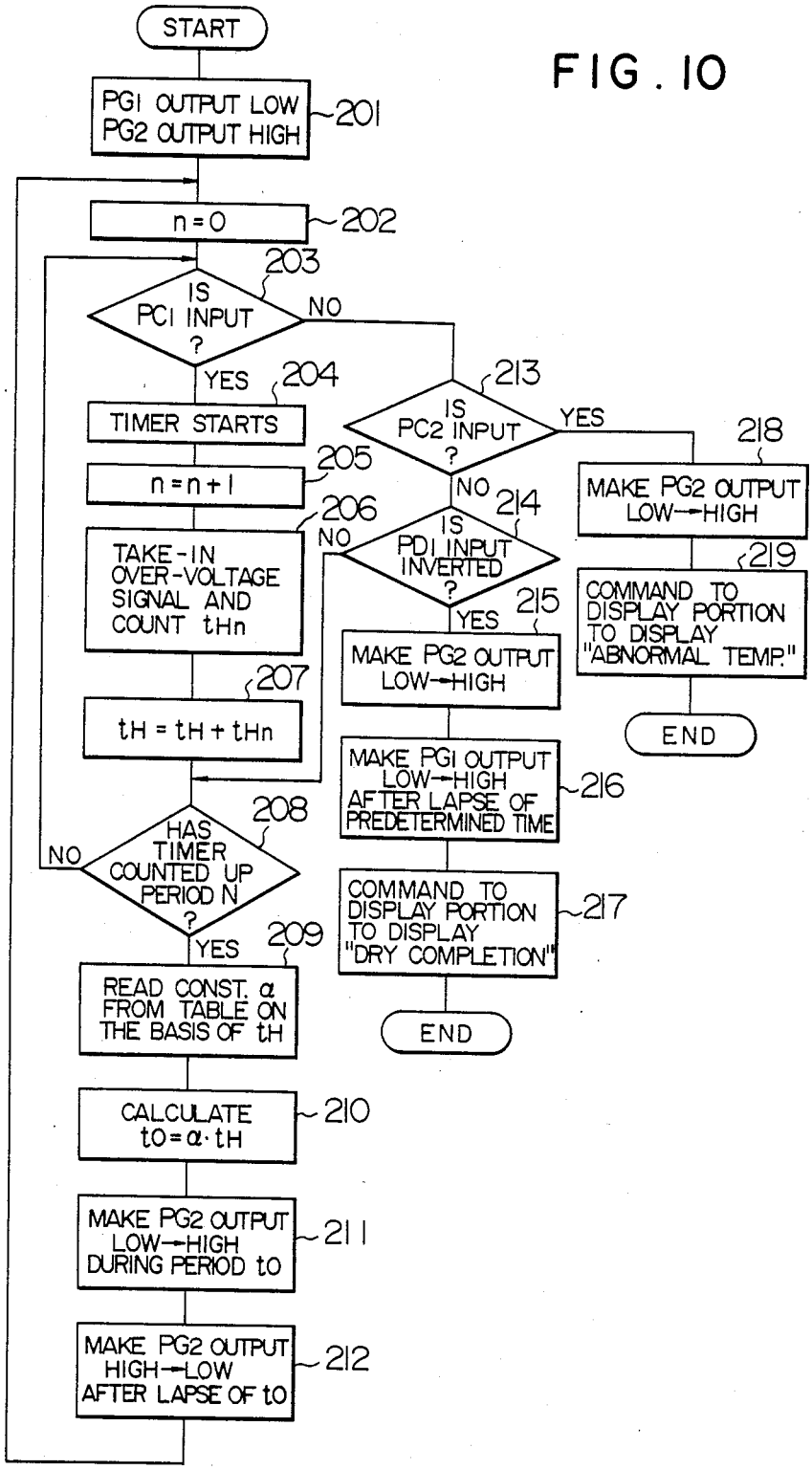
FIG. 10 is a flowchart showing a operation procedure of the microcomputer in a case of another embodiment of the present invention.
Figure 11:
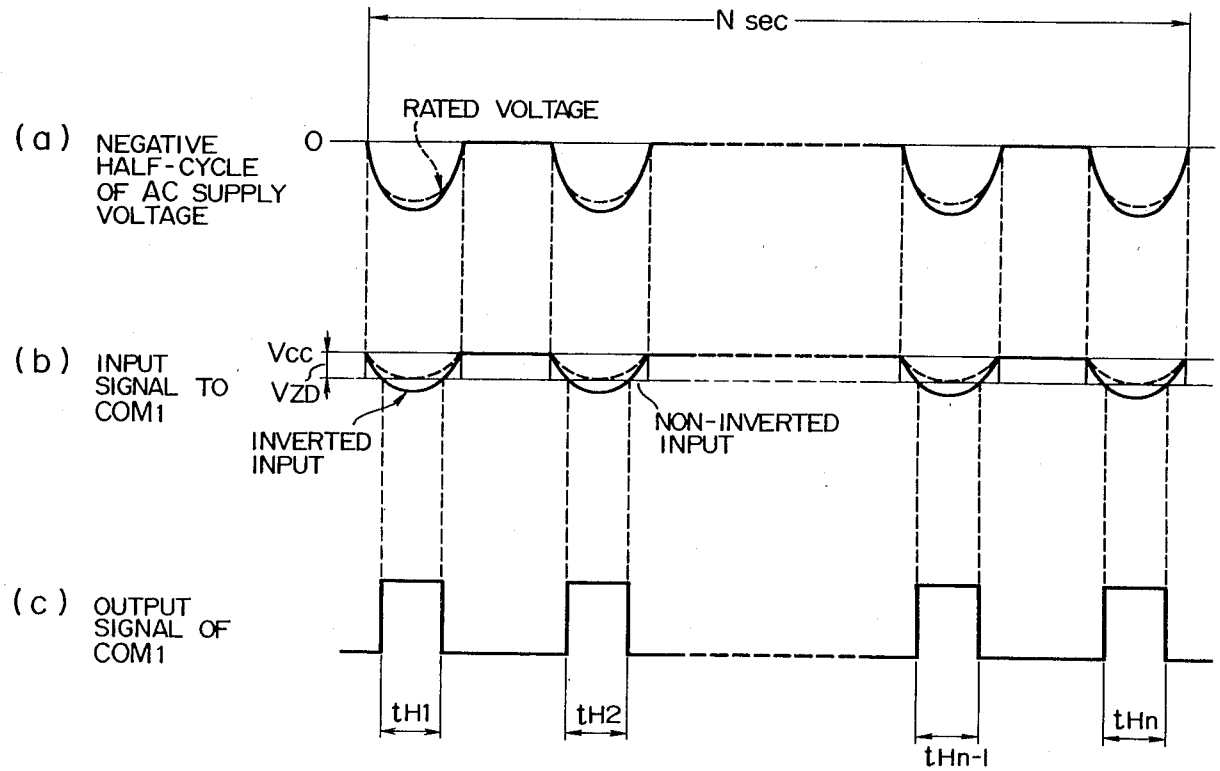
FIG. 11 is a diagram showing a waveforms for explaining the operation of the embodiment of FIG. 10.

FIG. 10 shows a flow chart of the operation in the another embodiment of the present invention. In this embodiment, time period $t_H$ is determined by accumulate a plurality of the output signals of comparater $COM_1$ which are produced during a predetermined period N sec. As shown in FIG. 11, $t_H$ is determined by following expression:

$$t_H = t_{H1} + t_{H2} + t_{H3} + \dots t_{Hn-1} + t_{Hn}$$

In this embodiment, $\alpha$ is previously determined by experiment so that time period $t_0$ which provides a heat value as same as that the rated voltage is applied to the heater.

The flow chart of FIG. 10 is basically same with that of FIG. 8. First, when the drying operation is instructed to the microcomputer 21 by turning on the start switch of the membrane switch 28 in a step 201, a low level signal is produced to the output ports $PG_1$ and $PG_2$. Next, in step 202, a counter is setted in n=0. Next, in a step 203, judgement is made as to whether there exists an input signal (an overvoltage signal) at the input port $PG_1$ or not. If yes, in a step 204 a timer starts to count time period N. In a step 205, the counter is incremented by one. In a step 206, the overvoltage signal is taken in. In a step 207, the time period $t_H$ is calculated. In a step 208, judgement is made as to whether the timer has counted the predetermined time period N. If the judgement is "NO" at step 208, the time period $t_H$ is revised by accumulating another time period $t_{Hn}$ until the time period N is elapsed. If the judgement is "YES" at step 208, a constant $\alpha$ corresponding to the accumulated value of the pulse width $t_H$ is determined at the next step 209. In a step 210, the value of the period $t_0$ during which the heater circuit is opened is calculated by performing an operation through an expression: $t_0 = \alpha \cdot t_H$. Since the other steps of FIG. 10 are similar to steps 007 to 015 of FIG. 8, the explanation of such steps are omitted.

The present invention is not limited to those embodiments described above and all the modifications in details are included in the present invention as long as they fall within the scope of the appended claims and they do not depart from the spirit of the present invention. For example, although a suction blower is employed in the foregoing embodiments, it is alternatively possible to use a pressure blower.

We claim:

1. A method of controlling an electric clothes dryer having an electrical heater arranged to be supplied with electric power from a power source to generate heat so as to dry clothes by air heated by said heater during a predetermined period in a drying process, said method comprising the steps of:

connecting said heater with said power source to supply said heater with electrical power;

detecting a voltage of said power source and for generating an overvoltage signal when the detected voltage exceeds a predetermined value, said overvoltage signal having a value corresponding to an excess of said detected voltage over said predetermined value;

determining a period of opening of said connection between said power source and said heater on the basis of said overvoltage signal so that a mean value of power consumption per unit time of said heater becomes a predetermined value;

opening said connection between said power source and said heater during said period of opening of said connection; and closing said connection between said power source and said heater after said period of opening of said connection has elapsed.

2. An apparatus for controlling an electric clothes dryer having an electrical heater arranged to be supplied with electric power from a power source to generate heat so as to dry clothes by air heated by said heater for a predetermined period in a drying process, said apparatus comprising:

switching means for opening/closing an electrical connection between said power source and said heater in response to a control signal;

voltage detecting means for detecting a voltage of said power source and for generating an overvoltage signal when the detected voltage exceeds a predetermined value, said overvoltage signal having a value corresponding to an excess of said detected voltage over said predetermined value; and control signal generating means responsive to said overvoltage signal for supplying said control signal to said switching means during said predetermined period in said drying process, said control signal generating means including opening/closing period determining means for determining a period of opening/closing operation of said switching means on the basis of said overvoltage signal, said period of opening/closing operation of said switching means being selected so that a mean value of power consumption per unit time of said heater always becomes a predetermined value when said heater is opened/closed during said opening/closing operation period.

3. The control apparatus according to claim 2, in which said opening/closing operation period determining means is arranged to determine a period of opening of said switching means on the basis of the value of said overvoltage signal so that said control signal generating means opens said switching means during said opening period and closes said switching means upon termination of said opening period.

4. The control apparatus according to claim 3, in which said control signal generating means includes a microcomputer which stores a table for indicating the opening period of said switching means so as to make said mean value of power consumption per unit time of said heater be said predetermined value.

5. The control apparatus according to claim 4, in which said voltage detecting means includes reference voltage generating means, source voltage detecting means, and comparator means for comparing the source voltage detected by said source voltage detecting means with said reference voltage generated by said reference voltage generating means to thereby produce an output signal corresponding to a difference between said source voltage and reference voltage.

6. The control apparatus according to claim 2, further comprising dry rate detecting means for detecting a rate of dry of the clothes, said control signal generating means being arranged to produce said control signal in response to said overvoltage signal and an output produced by said dry rate detecting means upon detecting a predetermined value of dry rate.

7. The control apparatus according to claim 6, in which said dry rate detecting means includes a semiconductor humidity sensor disposed at a position at which humidity of air passed through the clothes is sensed.

8. The control apparatus according to claim 6, in which said opening/closing operation period determining means is arranged to determine a period of opening of said switching means on the basis of the value of said overvoltage signal so that said control signal generating means opens said switching means during said opening period and closes said switching means upon termination of said opening period.

* * * * *